US006689735B2

(12) United States Patent
Singh et al.

(10) Patent No.: US 6,689,735 B2
(45) Date of Patent: Feb. 10, 2004

(54) DETERGENT COMPOSITIONS

(75) Inventors: Amrat Paul Singh, Wirral (GB); David Christopher Thorley, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/013,754

(22) Filed: Dec. 11, 2001

(65) Prior Publication Data

US 2002/0160929 A1 Oct. 31, 2002

(30) Foreign Application Priority Data

Dec. 15, 2000 (GB) ..... 0030669

(51) Int. Cl.[7] ..... C11D 1/86

(52) U.S. Cl. ..... 510/422; 510/276; 510/327; 510/330; 510/351; 510/356; 510/357; 510/384; 510/391; 510/421; 510/426; 510/427; 510/445; 510/504

(58) Field of Search ..... 510/276, 327, 510/330, 351, 356, 357, 384, 391, 421, 426, 445, 504, 422, 427

(56) References Cited

U.S. PATENT DOCUMENTS

| | | | | |
|---|---|---|---|---|
| 3,684,723 A | | 8/1972 | Best et al. | 152/132 |
| 3,983,078 A | | 9/1976 | Collins | 252/540 |
| 4,294,711 A | * | 10/1981 | Hardy et al. | 252/8.75 |
| 4,483,778 A | * | 11/1984 | Thompson et al. | 252/94 |
| 4,548,744 A | * | 10/1985 | Connor | 252/545 |
| 4,818,422 A | * | 4/1989 | Adams et al. | 252/8.8 |
| 4,876,023 A | | 10/1989 | Dickenson et al. | 252/90 |
| 4,957,647 A | * | 9/1990 | Zielske | 252/186.38 |
| 5,559,091 A | | 9/1996 | Geboes et al. | 510/422 |
| 5,668,100 A | | 9/1997 | Schmid et al. | 510/446 |
| 5,900,396 A | | 5/1999 | Cala et al. | 510/351 |
| 6,117,834 A | * | 9/2000 | Ruijter et al. | 510/475 |
| 6,440,926 B1 | * | 8/2002 | Spadoni et al. | 510/445 |

FOREIGN PATENT DOCUMENTS

| | | |
|---|---|---|
| DE | 43 13 949 | 11/1994 |
| DE | 43 20 851 | 1/1995 |
| EP | 000 225 | 1/1979 |
| EP | 142 910 | 5/1985 |
| EP | 164 072 | 12/1985 |
| EP | 287 343 | 10/1988 |
| EP | 293 139 | 11/1988 |
| EP | 495 345 | 7/1992 |
| GB | 2 279 660 | 1/1995 |
| WO | 92/18594 | 10/1992 |
| WO | 93/02176 | 2/1993 |
| WO | 93/19148 | 9/1993 |
| WO | 94/16052 | 7/1994 |
| WO | 97/43364 | 11/1997 |
| WO | 97/43365 | 11/1997 |
| WO | 97/43371 | 11/1997 |
| WO | 97/43387 | 11/1997 |
| WO | 97/43389 | 11/1997 |
| WO | 97/43390 | 11/1997 |
| WO | 97/43391 | 11/1997 |
| WO | 97/43393 | 11/1997 |
| WO | 98/17769 | 4/1998 |
| WO | 98/18892 | 5/1998 |

OTHER PUBLICATIONS

PCT International Search Report in a PCT application PCT/EP 01/14488.

PCT International Search Report in a PCT application PCT/EP 01/14487.

GB Search Report in a GB application GB 0030669.6.

GB Search Report in a GB application GB 0030671.2.

BASF Technical Information Bullentin, *Lutensol AO types*, Oct. 1995.

Co–pending Application: Applicant: Blything et al., Ser. No.: 10/013,790, Filed: Dec. 11, 2001.

PCT International Search Report in a PCT application PCT/GB 02/04122.

Derwent Abstract of DE 43 20 851 published Jan. 5, 1995.

PCT International Search Report in a PCT application PCT/GB 02/04154.

Derwent Abstract of DE 43 13 949 published Nov. 3, 1994.

Derwent Abstract of EP 164 072 published Dec. 11, 1985.

* cited by examiner

*Primary Examiner*—Charles Boyer
(74) *Attorney, Agent, or Firm*—Rimma Mitelman

(57) ABSTRACT

A built laundry detergent composition contains a combination of anionic, nonionic and cationic surfactants which includes a highly ethoxylated nonionic surfactant which is a $C_8$–$C_{16}$ alcohol ethoxylated with an average of from 20 to 50 ethylene oxide groups. The cationic surfactant may advantageously be an ethoxylated quaternary ammonium compound. The composition exhibits improved oily soil detergency.

9 Claims, No Drawings

DETERGENT COMPOSITIONS

TECHNICAL FIELD

The present invention relates to laundry detergent compositions containing a combination of anionic, specified nonionic and cationic surfactants giving improved oily soil detergency.

BACKGROUND

Heavy duty laundry detergent compositions have for many years contained anionic sulphonate or sulphate surfactant, for example, linear alkylbenzene sulphonate (LAS), together with ethoxylated nonionic surfactants. Examples abound in the published literature.

The preferred ethoxylated alcohol nonionic surfactants giving an optimum balance of properties have generally been those having an alkyl chain length of $C_{12}$–$C_{15}$ and an average degree of ethoxylation of 1 to 10, preferably 3 to 7, more preferably about 5.

Longer-chain alcohols having a higher degree of ethoxylation, for example, tallow alcohol ($C_{18}$) 11EO, have also been used.

These relatively hydrophobic materials of low HLB value are generally liquids at ambient temperature and exhibit excellent oily soil removal. Longer-chain alcohols having higher degrees of ethoxylation, for example, tallow ($C_{18}$) alcohol 25EO and 50EO, are solids at ambient temperature and are used as slowly dissolving coating materials, for example, for enzyme or antifoam granules.

Laundry detergent compositions containing cationic (quaternary ammonium) surfactants in combination with anionic and nonionic surfactants are widely disclosed in the patent literature.

It has now surprisingly been found that the combination of anionic and cationic surfactants together with ethoxylated alcohols combining a shorter alkyl chain length and a higher degree of ethoxylation can give enhanced oily soil removal.

PRIOR ART

WO 94 16052A (Unilever) discloses high bulk density laundry powders based on LAS and conventional nonionic surfactants, and containing small amounts of very highly ethoxylated alcohols, eg tallow alcohol 80EO, as a dissolution aid.

WO 93 02176A (Henkel) discloses the use of highly ethoxylated aliphatic alcohols as "structure breakers" in high bulk density powders containing conventional nonionic surfactants.

EP 293 139A (Procter & Gamble) discloses twin-compartment sachets containing detergent powders. Some powders contain very small amounts of tallow alcohol 25EO.

U.S. Pat. No. 4,294,711 (Procter & Gamble) discloses a textile softening heavy duty detergent composition containing 1 wt % of tallow alcohol 80EO.

WO 92 18594A (Procter & Gamble) discloses builder granules of layered silicate coated with tallow alcohol 50EO.

EP 142 910A and EP 495 345A (Procter & Gamble) disclose antifoam granules containing highly ethoxylated alcohols.

WO 93 19148A (Procter & Gamble) discloses liquid hard surface cleaning compositions containing highly ethoxylated nonionic surfactants optionally plus anionic surfactant.

WO 97 43364, WO 97 43365A, WO 97 43371A, WO 97 43387A, WO 97 43389A, WO 97 43390A, WO 97 43391A and WO 97 43393A, (Procter & Gamble) disclose laundry detergent compositions containing so-called "AQA" alkoxylated quaternary ammonium surfactants in combination with other surfactants.

DEFINITION OF THE INVENTION

The present invention provides a built laundry detergent composition comprising (i) from 5 to 40 wt %, preferably from 7 to 30 wt %, of surfactant consisting essentially of:

(i)(a) an anionic sulphonate or sulphate surfactant, (i)(b) an ethoxylated alcohol nonionic surfactant of the general formula I $$R—(—O—CH_2—CH_2)_n—OH \quad (I)$$

wherein R is a hydrocarbyl chain having from 8 to 16 carbon atoms, and the average degree of ethoxylation n is from 20 to 50, (i)(c) a quaternary ammonium cationic surfactant, (ii) from 10 to 80 wt % of detergency builder, (iii) optionally other detergent ingredients to 100 wt %.

The invention also provides a process for laundering textile fabrics by machine or hand, which includes the step of immersing the fabrics in a wash liquor comprising water in which a laundry detergent composition as defined in the previous paragraph is dissolved or dispersed.

The invention further provides the use of a surfactant (i) consisting essentially of (i)(a) an anionic sulphonate or sulphate surfactant, (i)(b) an ethoxylated alcohol nonionic surfactant of the general formula I $$R—(—O—CH_2—CH_2)_n—OH \quad (I)$$

wherein R is a hydrocarbyl chain having from 8 to 16 carbon atoms, and the average degree of ethoxylation n is from 20 to 50, (i)(c) a quaternary ammonium cationic surfactant, in a laundry detergent composition in an amount of from 5 to 40 wt %, to improve the oily soil detergency of the composition.

DETAILED DESCRIPTION OF THE INVENTION

The detergent compositions of the invention contain a combination of an anionic sulphonate or sulphate surfactant, a defined nonionic surfactant, and a cationic surfactant. The total amount of the three surfactants is from 5 to 40 wt %, preferably from 7 to 30 wt %.

Detergent compositions according to the invention show improved oily soil detergency across a range of fabrics and water hardnesses.

The Anionic Surfactant (i)(a)

The anionic surfactant is a sulphonate or sulphate anionic surfactant.

Anionic surfactants are well-known to those skilled in the art. Many suitable detergent-active compounds are available and are fully described in the literature, for example, in "Surface-Active Agents and Detergents", Volumes I and II, by Schwartz, Perry and Berch.

Examples include alkylbenzene sulphonates, primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Preferably the anionic surfactant is linear alkylbenzene sulphonate or primary alcohol sulphate. More preferably the anionic surfactant is linear alkylbenzene sulphonate.

The Ethoxylated Nonionic Surfactant (i)(b)

The nonionic surfactant is an ethoxylated aliphatic alcohol of the formula $$R—(—O—CH_2—CH_2)_n—OH$$

wherein R is a hydrocarbyl chain having from 8 to 16 carbon atoms, and the average degree of ethoxylation n is from 20 to 50.

The hydrocarbyl chain, which is preferably saturated, preferably contains from 10 to 16 carbon atoms, more preferably from 12 to 15 carbon atoms. In commercial materials containing a spread of chain lengths, these figures represent an average.

The alcohol may be derived from natural or synthetic feedstock. Preferred alcohol feedstocks are coconut, predominantly $C_{12}$–$C_{14}$, and oxo $C_{12}$–$C_{15}$ alcohols. Longer chain materials such as tallow or hardened tallow ($C_{18}$) are not preferred.

The average degree of ethoxylation ranges from 20 to 50, preferably from 25 to 40.

Preferred materials have an average alkyl chain length of $C_{12}$–$C_{16}$ and an average degree of ethoxylation of 25 to 40.

An example of a suitable commercially available material is Lutensol (Trade Mark) AO30, ex BASF, which is a $C_{13}$–$C_{15}$ alcohol having an average degree of ethoxylation of 30.

The Cationic Surfactant (i)(c)

Preferred water-soluble cationic surfactants are quaternary ammonium salts of the general formula II $$R_1R_2R_3R_4N^+X^- \quad \text{(II)}$$

wherein $R_1$ is a relatively long ($C_8$–$C_{18}$) hydrocarbon chain, typically an alkyl, hydroxyalkyl or ethoxylated alkyl group, optionally interrupted with a heteroatom or an ester or amide group; each of $R_2$, $R_3$ and $R_4$ (which may be the same or different) is a short-chain ($C_1$–$C_3$) alkyl or substituted alkyl group; and X is a solubilising anion, for example a chloride, bromide or methosulphate ion.

According to a first preferred embodiment of the invention, the cationic surfactant is a quaternary ammonium compound of the formula II in which $R_1$ is a $C_8$–$C_{18}$ alkyl group, more preferably a $C_8$–$C_{10}$ or $C_{12}$–$C_4$ alkyl group, $R_2$ is a methyl group, and $R_3$ and $R_4$, which may be the same or different, are methyl or hydroxyethyl groups. Such compounds have the formula III:

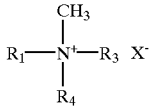

(III)

In an especially preferred compound, $R_1$ is a $C_{12}$–$C_{14}$ alkyl group, $R_2$ and $R_3$ are methyl groups, $R_4$ is a 2-hydroxyethyl group, and $X^-$ is a chloride ion. This material is available commercially as Praepagen (Trade Mark) HY from Clariant GmbH, in the form of a 40 wt % aqueous solution.

According to a second preferred embodiment of the invention, the cationic surfactant is an ethoxylated quaternary ammonium compound of the formula IV:

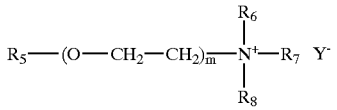

(IV)

wherein $R_5$ is a $C_6$–$C_{20}$ alkyl group, m is an integer from 1 to 20, $R_6$ and $R_7$, which may be the same or different, each represents a $C_1$–$C_4$ alkyl group or a $C_2$–$C_4$ hydroxyalkyl group, $R_8$ represents a $C_1$–$C_4$ alkyl group, and $Y^-$ represents a monovalent solubilising anion.

In preferred ethoxylated cationic surfactants of the formula IV used in accordance with the invention, $R_5$ is a $C_{10}$–$C_6$ alkyl group, m is from 1 to 4, $R_6$, $R_7$ and $R_8$ are methyl groups, and $Y^-$ represents $Cl^-$.

An especially preferred ethoxylated cationic surfactant used in accordance with the present invention is of the formula IV in which $R_5$ is a $C_{12}$–$C_{14}$ alkyl group, m is 3, $R_6$, $R_7$ and $R_8$ are methyl groups, and $Y^-$ represents $Cl^-$.

This material (DBETAC) has the formula V

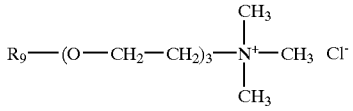

(V)

wherein $R_9$ is a $C_{12}$–$C_{14}$ alkyl group.

Other classes of cationic surfactant include cationic esters (for example, choline esters).

The Surfactant Combination (i)

The surfactant combination preferably consists essentially of:

(i)(a) from 20 to 98 wt % of the anionic sulphonate or sulphate detergent;

(i)(b) from 1 to 60 wt % of the nonionic surfactant, and (i)(c) from 1 to 60 wt % of the cationic surfactant.

The whole product preferably contains from:

(i)(a) from 1 to 20 wt % of the anionic sulphonate or sulphate detergent;

(i)(b) from 0.5 to 20 wt % of the nonionic surfactant, and (i)(c) from 0.1 to 20 wt % of the cationic surfactant.

Preferred weight ratios are as follows:

| | |
|---|---|
| (i)(a):(i)(b) | 1.5:1–25:1 |
| (i)(a):(i)(c) | 0.2:1–5:1 |
| (i)(b):(i)(c) | 0.1:1–3:1 |

In the first preferred embodiment of the invention wherein the cationic surfactant is a compound of the formula III, then the surfactant system is preferably composed as follows:

(i)(a) from 50 to 98 wt %, preferably from 60 to 95 wt %, of the anionic sulphonate or sulphate detergent;

(i)(b) from 1 to 30 wt %, preferably from 5 to 25 wt %, of the nonionic surfactant, and (i)(c) from 1 to 30 wt %, preferably from 5 to 25 wt %, of the cationic surfactant.

The whole product preferably contains:

(i)(a) from 3 to 30 wt %, preferably from 5 to 25 wt %, of the anionic sulphonate or sulphate detergent;

(i)(b) from 0.5 to 10 wt %, preferably from 1 to 5 wt %, of the nonionic surfactant, and (i)(c) from 0.1 to 10 wt %, preferably from 0.2 to 5 wt %, of the cationic surfactant.

Preferred weight ratios are as follows:

| | Preferred | Most preferred |
|---|---|---|
| (i)(a):(i)(b) | 2:1–25:1 | 3:1–20:1 |
| (i)(a):(i)(c) | 2:1–50:1 | 3:1–30:1 |
| (i)(b):(i)(c) | 0.1:1–3:1 | 0.5:1–2:1 |

In the second preferred embodiment of the invention wherein the cationic surfactant is an ethoxylated compound of the formula IV, then the surfactant system is preferably composed as follows:

(i)(a) from 20 to 80 wt %, preferably from 30 to 60 wt %, of the anionic sulphonate or sulphate detergent;

(i)(b) from 5 to 40 wt %, preferably from 10 to 30 wt %, of the nonionic surfactant, and (i)(c) from 10 to 60 wt % preferably from 20 to 50 wt %, of the cationic surfactant.

The whole product preferably contains:

(i)(a) from 3 to 30 wt %, preferably from 5 to 25 wt %, of the anionic sulphonate or sulphate detergent;

(i)(b) from 0.5 to 10 wt %, preferably from 1 to 5 wt %, of the nonionic surfactant, and (i)(c) from 0.1 to 10 wt %, preferably from 0.2 to 5 wt %, of the cationic surfactant.

Preferred weight ratios are as follows:

| | Preferred | Most preferred |
|---|---|---|
| (i)(a):(i)(b) | 1.5:1–10:1 | 1:1–5:1 |
| (i)(a):(i)(c) | 0.2:1–5:1 | 0.5:1–3:1 |
| (i)(b):(i)(c) | 0.2:1–5:1 | 0.5:1–3:1 |

Optionally minor, non-interfering amounts of other surfactants may also be present. Preferably, however, the composition is free from nonionic surfactants other than the defined nonionic surfactant (i)(b).

More preferably the composition is substantially free of other non-soap surfactants.

Optionally soap may also be present, for example, in an amount of from 1 to 5 wt %.

Detergency Builder (ii)

The compositions may suitably contain from 10 to 80%, preferably from 15 to 70% by weight, of detergency builder. Preferably, the quantity of builder is in the range of from 15 to 50% by weight.

Preferably the builder is selected from sodium tripolyphosphate, zeolite, sodium carbonate, sodium citrate, layered silicate, and combinations of these.

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Ineos Silicas Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxy-methyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Other Detergent Ingredients

As well as the surfactants and builders discussed above, the compositions may optionally contain bleaching components and other active ingredients to enhance performance and properties.

These optional ingredients may include, but are not limited to, any one or more of the following: soap, peroxyacid and persalt bleaches, bleach activators, sequestrants, cellulose ethers and esters, other antiredeposition agents, sodium sulphate, sodium silicate, sodium chloride, calcium chloride, sodium bicarbonate, other inorganic salts, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, fabric conditioning compounds, coloured speckles, and perfume.

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Product Form and Preparation

The compositions of the invention may be of any suitable physical form, for example, particulates (powders, granules, tablets), liquids, pastes, gels or bars.

According to one especially preferred embodiment of the invention, the detergent composition is in particulate form.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

Also preferred are liquid detergent compositions, which may be prepared by admixing the essential and optional ingredients in any desired order to provide compositions containing the ingredients in the the requisite concentrations.

EXAMPLES

The invention is illustrated in further detail by the following non-limiting Examples, in which parts and percentages are by weight unless otherwise stated.

Examples 1 to 8, Comparative Examples A to N

Performance Appraisal of Anionic/Nonionic/Cationic Surfactant Mixtures on Various Soils Surfactant mixtures were prepared by mixing sodium linear alkylbenzene sulphonate (LAS), the ethoxylated nonionic surfactant Lutensol AO30 (R=$C_{12}$–$C_{15}$ alkyl, n has an average value of 30), and the cationic surfactant Praepagen HY ($C_{12}$–$C_{14}$ alkyl methyl hydroxyethyl ammonium chloride) in various proportions. High suds detergent compositions suitable for machine or handwash were prepared to the following general formulation:

| | |
|---|---|
| Total surfactant (LAS + Lutensol AO30 + Praepagen HY) | 24.00 |
| Sodium tripolyphosphate | 14.50 |
| Sodium carboxymethyl cellulose | 0.33 |
| Sodium neutral silicate | 6.98 |
| Sodium sulphate | 17.75 |
| Fluorescers | 0.19 |
| Acrylic/maleic copolymer | 1.50 |
| Sodium carbonate | 15.00 |
| Sodium perborate monohydrate | 8.00 |
| Tetracetyl ethylenediamine | 2.40 |
| Phosphonate sequestrant | 0.40 |
| Enzyme granules | 0.91 |
| Antifoam granules | — |
| Soil release polymer | 0.80 |
| Perfume | 0.30 |
| Miscellaneous salts, water etc | to 100 |

Soil removal performance on knitted cotton and polyviscose fabrics was measured in a tergotometer test. The soils used were Soil A: soya bean oil (chosen as a typical greasy kitchen soil), coloured with a violet dye (0.08 wt %) to act as a visual indicator.

Soil B: paraffinic oil with particulate iron and carbon dispersed therein (no indicator dye was needed because the soil was itself sufficiently coloured by the presence of the particulate material)

Soil C: multi-use oil.

Test cloths (10 cm×10 cm), each soiled with 0.5 ml of one of the soils listed above, were washed in tergotometers using the detergent compositions above under the following conditions:

| | |
|---|---|
| Temperature | 25° C. |
| Liquor to cloth ratio | 30:1 |
| Product dosage | 2.0 g/l |
| Soak time | 10 min |
| Wash time (agitation) | 15 min |

The water used was of a hardness corresponding to a $pK_{Ca}^{2-}$ of 6.4.

The reflectance ΔE, indicative of total colour change (of the violet dye) across the whole visible spectrum, of each test cloth was measured before and after the wash. The results, expressed as the difference ΔΔE between reflectance values ΔE before and after the wash, are shown in the following tables.

Example 1, Comparative Examples A to C

Soil A on Knitted Polyviscose

| | wt % of total surfactant | | | |
|---|---|---|---|---|
| Example | LAS | Nonionic | Cationic | ΔΔE |
| A | 100 | 0 | 0 | 8.6 |
| B | 90 | 10 | 0 | 9.9 |
| C | 90 | 0 | 10 | 8.7 |
| 1 | 90 | 5 | 5 | 10.7 |

Examples 2 and 3, Comparative Examples D to F

Soil C on Knitted Cotton

| | wt % of total surfactant | | | |
|---|---|---|---|---|
| Example | LAS | Nonionic | Cationic | ΔΔE |
| D | 100 | 0 | 0 | 20.0 |
| E | 80 | 20 | 0 | 15.5 |
| F | 80 | 0 | 20 | 19.3 |
| 2 | 80 | 10 | 10 | 21.6 |
| 3 | 60 | 20 | 20 | 22.5 |

Examples 4 and 5, Comparative Examples G to I

Soil C on Knitted Polyviscose

| | wt % of total surfactant | | | |
|---|---|---|---|---|
| Example | LAS | Nonionic | Cationic | ΔΔE |
| G | 100 | 0 | 0 | 16.0 |
| H | 80 | 20 | 0 | 2.2 |
| I | 80 | 0 | 20 | 14.0 |
| 4 | 80 | 10 | 10 | 18.8 |
| 5 | 60 | 20 | 20 | 17.8 |

Examples 6 to 8, Comparative Examples J to N

Soil B on Knitted Polyviscose

| | wt % of total surfactant | | | |
|---|---|---|---|---|
| Example | LAS | Nonionic | Cationic | ΔΔE |
| J | 100 | 0 | 0 | 3.64 |
| K | 90 | 10 | 0 | 4.9 |
| L | 90 | 0 | 10 | 3.4 |
| 6 | 90 | 5 | 5 | 8.0 |
| M | 80 | 20 | 0 | 3.6 |
| N | 80 | 0 | 20 | 3.1 |

-continued

| | wt % of total surfactant | | | |
|---|---|---|---|---|
| Example | LAS | Nonionic | Cationic | ΔΔE |
| 7 | 80 | 10 | 10 | 4.7 |
| 8 | 60 | 20 | 20 | 6.0 |

Example 9, Comparative Examples P and Q

Performance Appraisal of Anionic/Nonionic/Cationic Surfactant Mixtures Containing Ethoxylated Cationic Surfactant (DBETAC)

High-suds detergent compositions according to the general formulation given in the previous Examples were prepared containing the surfactant systems shown below. The total amount of surfactant in each case was 24 wt % of the formulation.

DBETAC is the compound of the formula V as given previously:

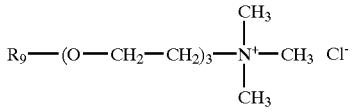

(II)

wherein $R_9$ is a $C_{12}$–$C_{14}$ alkyl group.

| Example | LAS | Nonionic AO30 | Cationic DBETAC |
|---|---|---|---|
| P | 100 | 0 | 0 |
| Q | 50 | 0 | 50 |
| 9 | 40 | 20 | 20 |

Performance was appraised, using the method of previous Examples, on Soil B and knitted cotton or polyviscose in water of three different hardnesses.

| Knitted Cotton | | | |
|---|---|---|---|
| | Water hardness | | |
| | 6° French | 20° French | 40° French |
| P | 13.0 | 10.5 | 13.9 |
| Q | 8.2 | 5.1 | 5.8 |
| 9 | 13.9 | 14.4 | 12.2 |

| Knitted polyviscose | | | |
|---|---|---|---|
| | Water hardness | | |
| | 6° French | 20° French | 40° French |
| P | 4.7 | 9.3 | 9.2 |
| Q | 5.0 | 4.0 | 1.8 |
| 9 | 11.3 | 11.6 | 9.7 |

These results show how the ternary system gives a robust performance across a wide range of water hardnesses.

Examples 10 to 12

Particulate Detergent Compositions Containing Lutensol AO30 and Praepagen HY

Example 10

High suds formulation similar to that used in earlier Examples

| | |
|---|---|
| LAS | 21.60 |
| Nonionic (Lutensol AO30) | 1.20 |
| Cationic (Praepagen HY) | 1.20 |
| Total surfactant | 24.00 |
| Sodium tripolyphosphate | 19.00 |
| Sodium carboxymethyl cellulose | 0.33 |
| Sodium neutral silicate | 6.98 |
| Sodium sulphate | 13.70 |
| Fluorescers | 0.19 |
| Acrylic/maleic copolymer | 1.50 |
| Sodium carbonate | 15.00 |
| Sodium perborate monohydrate | 8.00 |
| Tetracetyl ethylenediamine | 2.40 |
| Phosphonate sequestrant | 0.40 |
| Enzyme granules | 0.91 |
| Soil release polymer | 0.80 |
| Perfume | 0.30 |
| Miscellaneous salts, water etc | to 100 |

Example 11

Low suds formulation suitable for use in a closed drum washing machine

| | |
|---|---|
| LAS | 5.80 |
| Nonionic (Lutensol AO30) | 2.00 |
| Cationic (Praepagen HY) | 2.00 |
| Total surfactant | 9.80 |
| Soap | 4.00 |
| Sodium tripolyphosphate | 25.00 |
| Sodium carboxymethyl cellulose | 0.50 |
| Sodium neutral silicate | 8.96 |
| Sodium sulphate | 22.84 |
| Fluorescers | 0.13 |
| Sodium carbonate | 6.31 |
| Sodium perborate monohydrate | 5.84 |
| Tetracetyl ethylenediamine | 2.10 |
| Phosphonate sequestrant | 0.50 |
| Enzyme granules | 0.97 |
| Antifoam granules | 2.00 |
| Soil release polymer | 0.50 |
| Perfume | 0.36 |
| Miscellaneous salts, water etc | to 100 |

Example 12

Medium suds formulation suitable for use in a top-loading washing machine or for washing by hand

| | |
|---|---|
| LAS | 13.00 |
| Nonionic (Lutensol AO30) | 2.40 |
| Cationic (Praepagen HY) | 0.50 |
| Total surfactant | 15.90 |

-continued

| | |
|---|---|
| Sodium tripolyphosphate | 34.00 |
| Sodium carboxymethyl cellulose | 0.50 |
| Sodium silicate | 7.00 |
| Sodium hydroxide | 0.45 |
| Sodium chloride | 2.00 |
| Fluorescers | 0.15 |
| Silicone fluid antifoam | 0.05 |
| Acrylic polymer | 1.00 |
| Sodium aluminosilicate | 0.50 |
| Sodium carbonate | 3.58 |
| Sodium perborate tetrahydrate | 7.67 |
| Tetracetyl ethylenediamine | 2.21 |
| Enzyme granules | 1.64 |
| Soil release polymer | 0.35 |
| Citric acid | 1.00 |
| Antifoam granules | 3.00 |
| Coloured speckles (sodium tripolyphosphate) | 1.80 |
| Perfume | 0.33 |
| Miscellaneous salts, water etc | to 100 |

Examples 13 and 14

Detergent Compositions Containing Lutensol AO30 and DBETAC

Example 13

Low suds formulation suitable for use in a closed drum washing machine.

| | |
|---|---|
| LAS | 3.90 |
| Nonionic (Lutensol AO30) | 2.00 |
| Cationic (DBETAC) | 2.00 |
| Total surfactant | 7.90 |
| Soap | 4.00 |
| Sodium tripolyphosphate | 25.00 |
| Sodium carboxymethyl cellulose | 0.50 |
| Sodium neutral silicate | 8.96 |
| Sodium sulphate | 22.84 |
| Fluorescers | 0.13 |
| Acrylic/maleic copolymer | — |
| Sodium carbonate | 6.31 |
| Sodium perborate monohydrate | 5.84 |
| Tetracetyl ethylenediamine | 2.10 |
| Phosphonate sequestrant | 0.50 |
| Enzyme granules | 0.97 |
| Antifoam granules | 2.00 |
| Soil release polymer | 0.50 |
| Perfume | 0.36 |
| Miscellaneous salts, water etc | to 100 |

Example 14

Medium suds formulation suitable for use in a top-loading washing machine or for washing by hand.

| | |
|---|---|
| LAS | 5.40 |
| Nonionic (Lutensol AO30) | 3.20 |
| Cationic (DBETAC) | 6.40 |
| Total surfactant | 15.00 |
| Sodium tripolyphosphate | 34.00 |
| Sodium carboxymethyl cellulose | 0.50 |
| Sodium silicate | 7.00 |
| Sodium hydroxide | 0.45 |
| Sodium chloride | 2.00 |

-continued

| | |
|---|---|
| Fluorescers | 0.15 |
| Silicone fluid antifoam | 0.05 |
| Acrylic polymer | 1.00 |
| Sodium aluminosilicate | 0.50 |
| Sodium carbonate | 3.58 |
| Sodium perborate tetrahydrate | 7.67 |
| Tetracetyl ethylenediamine | 2.21 |
| Enzyme granules | 1.64 |
| Soil release polymer | 0.35 |
| Citric acid | 1.00 |
| Antifoam granules | 3.00 |
| Coloured speckles (sodium tripolyphosphate) | 1.80 |
| Perfume | 0.33 |
| Miscellaneous salts, water etc | to 100 |

We claim:

1. A built laundry detergent composition comprising:

(i) from 5 to 40 wt % of surfactant consisting essentially of:

(i)(a) an anionic sulfonate or sulfate surfactant, (i)(b) an ethoxylated alcohol nonionic surfactant of the general formula I $$R—(—O—CH_2—CH_2)_n—OH \quad (I)$$

wherein R is a hydrocarbyl chain having from 8 to 16 carbon atoms, and the average degree of ethoxylation n is from 20 to 50, (i)(c) a quaternary ammonium cationic surfactant, which is an ethoxylated quaternary ammonium compound of the formula IV:

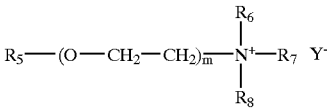

(IV)

wherein $R_5$ is a $C_6$–$C_{20}$ alkyl group, m is an integer from 1 to 20, $R_6$ and $R_7$ which may be the same or different, each represents a $C_1$–$C_4$ alkyl group or a $C_2$–$C_4$ hydroxyalkyl group, $R_8$ represents a $C_1$–$C_4$ alkyl group, and Y represents a monovalent solubilising anion;

(ii) from 10 to 80 wt % of detergency builder, (iii) optionally other detergent ingredients to 100 wt %.

2. A detergent composition as claimd in claim 1, wherein the cationic surfactant (i)(c) is a compound of the formula IV in which $R_5$ is a $C_{10}$–$C_{16}$ alkyl group, m is from 1 to 4, $R_6$, $R_7$ and $R_8$ are methyl groups, and Y represents Cl.

3. A detergent composition as claimed in claim 2, wherein the cationic surfactant (i)(c) is a compound of the formula V:

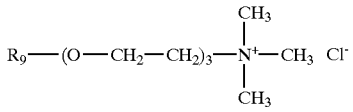

(V)

wherein $R_9$ is a $C_{12}$–$C_{14}$ alkyl group.

4. A detergent composition as claimed in claim 1, wherein the surfactant (i) consists essentially of:

(i)(a) from 20 to 80 wt % of the anionic sulfonate or sulfate detergent;

(i)(b) from 5 to 40 wt % of the nonionic surfactant, and (i)(c) from 10 to 60 wt % of the cationic surfactant.

5. A detergent composition as claimed in claim 4, wherein the surfactant (i) consists essentially of:

(i)(a) from 30 to 60 wt % of the anionic sulfonate or sulfate detergent;

(i)(b) from 10 to 30 wt % of the nonionic surfactant, and (i)(c) from 20 to 50 wt % of the cationic surfactant.

6. A detergent composition as claimed in claim 1, which comprises, based on the composition:

(i)(a) from 3 to 30 wt % of the anionic sulfonate or sulfate detergent;

(i)(b) from 0.5 to 10 wt % of the nonionic surfactant, and (i)(c) from 0.1 to 10 wt % of the cationic surfactant.

7. A detergent composition as claimed in claim 1, which comprises, based on the composition:

(i)(a) from 5 to 25 wt % of the anionic sulfonate or sulfate detergent;

(i)(b) from 1 to 5 wt % of the non ionic surfactant, and (i)(c) from 0.2 to 5 wt % of the cationic surfactant.

8. A detergent composition as claimed in claim 1, wherein the weight ratios between the surfactants are within the following ranges:

| | |
|---|---|
| (i) (a):(i) (b) | 1.5:1–10:1 |
| (i) (a):(i) (c) | 0.2:1–5:1 |
| (i) (b):(i) (c) | 0.2:1–5:1. |

9. A detergent composition as claimed in claim 8, wherein the weight ratios between the surfactants are within the following ranges:

| | |
|---|---|
| (i) (a):(i) (b) | 1:1–5:1 |
| (i) (a):(i) (c) | 0.5:1–3:1 |
| (i) (b):(i) (c) | 0.5:1–3:1. |

* * * * *